US006926552B2

(12) United States Patent
Mueller et al.

(10) Patent No.: US 6,926,552 B2
(45) Date of Patent: Aug. 9, 2005

(54) ELECTRICAL CABLE CONNECTOR

(75) Inventors: Thomas R. Mueller, Swartz Creek, MI (US); Randall J. Robson, Lapeer, MI (US); Martin T. Duane, Rochester Hills, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 138 days.

(21) Appl. No.: 10/264,148

(22) Filed: Oct. 3, 2002

(65) Prior Publication Data

US 2004/0067684 A1 Apr. 8, 2004

(51) Int. Cl.[7] ..... H01R 13/62
(52) U.S. Cl. ..... 439/371
(58) Field of Search ..... 439/371, 581, 439/582, 916, 289, 63; 174/117 A

(56) References Cited

U.S. PATENT DOCUMENTS

| | | | | | |
|---|---|---|---|---|---|
| 4,061,969 | A | * | 12/1977 | Dean | 324/761 |
| 4,685,752 | A | * | 8/1987 | Costar | 439/96 |
| 4,734,046 | A | * | 3/1988 | McAllister et al. | 439/101 |
| 4,734,050 | A | * | 3/1988 | Negre et al. | 439/289 |
| 4,862,183 | A | * | 8/1989 | Blaese | 343/715 |
| 4,910,415 | A | | 3/1990 | Yoshimura | |
| 4,911,660 | A | | 3/1990 | Alf et al. | |
| 5,281,760 | A | * | 1/1994 | Kikuchi et al. | 174/74 R |
| 5,835,071 | A | | 11/1998 | Phelps | |
| 5,842,873 | A | * | 12/1998 | Gonzales | 439/63 |
| 6,005,527 | A | | 12/1999 | Gomez et al. | |
| 6,087,996 | A | | 7/2000 | Dery | |
| 6,139,351 | A | | 10/2000 | Schaefer et al. | |
| 6,161,894 | A | | 12/2000 | Chapman | |
| 6,162,085 | A | | 12/2000 | Chugh et al. | |
| 6,176,715 | B1 | | 1/2001 | Buescher | |
| 6,211,831 | B1 | | 4/2001 | Nagy et al. | 343/713 |
| 6,232,556 | B1 | | 5/2001 | Daugherty et al. | |
| 6,247,965 | B1 | | 6/2001 | Cummings et al. | |
| 6,266,023 | B1 | | 7/2001 | Nagy et al. | 343/713 |
| 6,280,241 | B2 | | 8/2001 | Herlinger et al. | |
| 6,307,515 | B1 | | 10/2001 | Sauer et al. | |
| 6,307,516 | B1 | | 10/2001 | Zafar | 343/713 |
| 6,383,033 | B1 | | 5/2002 | Politsky et al. | |
| 6,428,355 | B1 | * | 8/2002 | Machado | 439/578 |

FOREIGN PATENT DOCUMENTS

| | | | |
|---|---|---|---|
| DE | 10019540 | 10/2001 | H01R/4/04 |
| DE | 20208703 | 9/2002 | H01R/12/32 |

* cited by examiner

*Primary Examiner*—Phuong Dinh
(74) *Attorney, Agent, or Firm*—Stefan V. Chmielewski

(57) ABSTRACT

An electrical connector includes a housing having a cavity and a surface for engaging a window. The connector includes first and second compressible conductive contacts disposed within the cavity of the housing and in electrical contact with circuit elements in a coaxial cable. The compressible conductive contacts are compressed to contact circuit elements formed on the window when the surface of the housing is engaged to the window to provide electrical connections.

32 Claims, 3 Drawing Sheets

ELECTRICAL CABLE CONNECTOR

TECHNICAL FIELD

The present invention generally relates to electrical connections between circuit elements and, more particularly, to an electrical connector for connecting an electrical cable to circuitry on a dielectric medium, such as a glass window.

BACKGROUND OF THE INVENTION

Many automotive vehicles are equipped with a backlite antenna element embedded in a rear window of the vehicle. Additionally, a vehicle window may include defogger elements that transmit electrical current to generate heat on the window. Some vehicles incorporate the antenna element and the defogger elements integrated within a single window. Examples of antenna elements and defogger elements are disclosed in U.S. Pat. Nos. 6,307,516, 6,266,023, and 6,211,831, the entire disclosures of which are hereby incorporated herein by reference.

The antenna and defogger elements provided on a window of a vehicle typically include termination input/output contact pads which are electrically coupled to other circuitry within the vehicle. For example, a radio antenna may include a radio frequency (RF) signal line electrically coupled to the central conductor in a coaxial cable. The coaxial cable typically includes a conductive ground shield formed around the central RF signal line. For resistive defogger elements, the input and output contact pads may be electrically coupled to a voltage supply and a return ground line for providing a current path through the defogger elements.

Conventional vehicle window mounted antennas and defogger elements typically are connected to a coaxial cable having metal connectors forming male members which are inserted into female connectors coupled to the contact pads on the window. The coaxial cables are typically attached to an electronic module, such as antenna amplifiers, filters, etc., via mechanical pressed together connections formed on loose electrical lead lines. The electrical leads of the cable are first attached to connectors via a crimping/stacking/soldering process. During installation, the male connectors are inserted into the female connectors on the module. This installation process typically requires a degree of skill and strength to matingly seat the connectors. Often the coaxial cable is inserted into the module before installation of the module into the vehicle to facilitate cable/module installation. However, rough handling (e.g., using the cable as a handle) can compromise the electrical connections in the cable and/or the module.

Accordingly, it is therefore desirable to provide for an electrical connector for connecting a cable to electrical circuitry formed on a dielectric medium, such as a glass window, that allows for easy assembly with reduced metal-to-metal terminal contacts and reduced soldering.

SUMMARY OF THE INVENTION

In accordance with the teachings of the present invention, an electrical connector is provided for electrically coupling a first circuit element in a cable to a second circuit element on a dielectric medium. The electrical connector includes a housing connected to an electrical cable having a first circuit element. The housing has a cavity and a surface for engaging a dielectric medium. The electrical connector includes a compressible conductive contact disposed within the cavity of the housing and electrically coupled to the first circuit element. The conductive contact is compressed to contact a second circuit element formed on the dielectric medium when the surface of the housing is engaged to the dielectric medium to provide an electrical connection.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
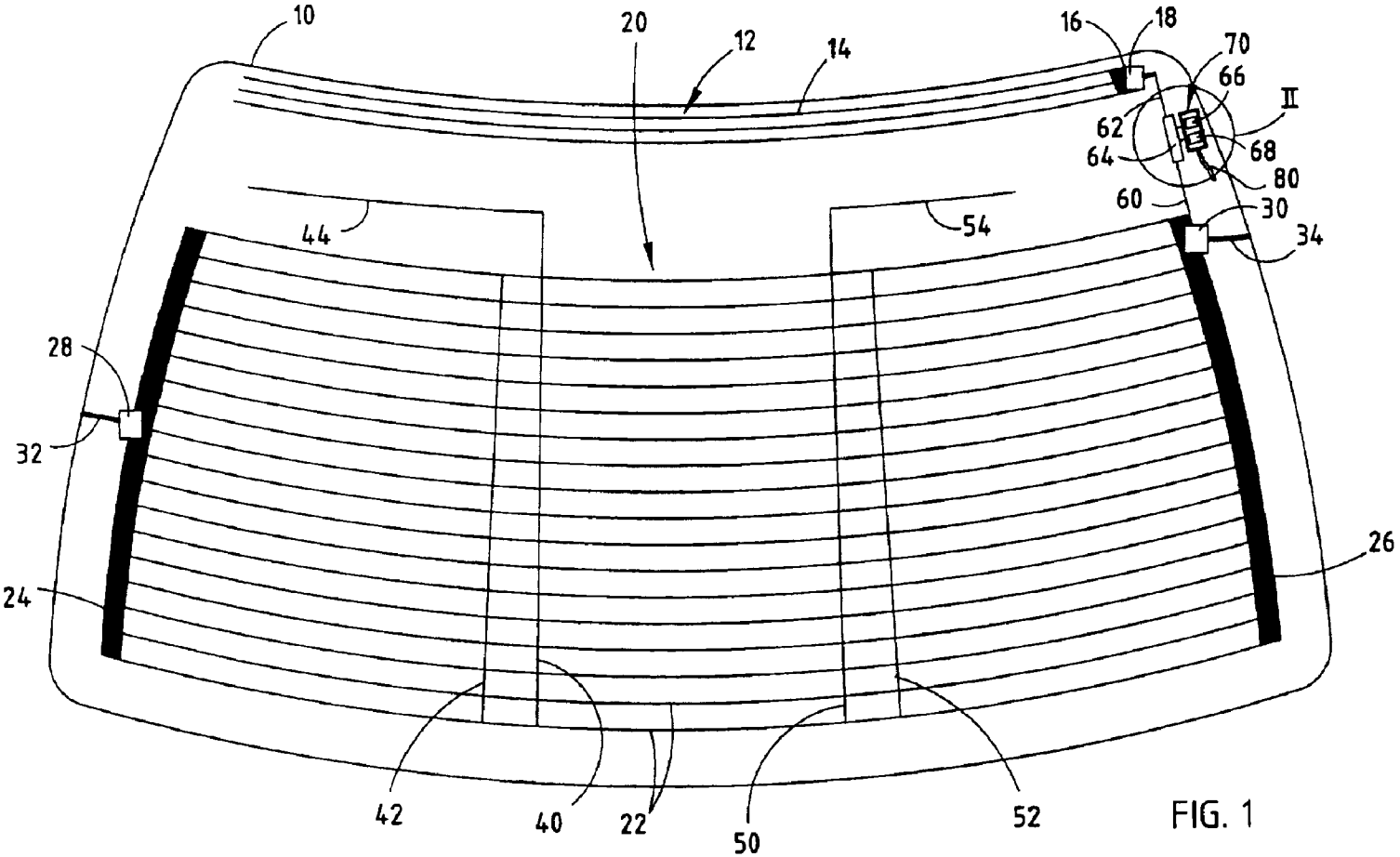
FIG. 1 is a front elevational view of a rear window of a vehicle incorporating antenna and defogger elements having an electrical cable connector according to the present invention.

Referring to FIG. 1, the rear transparent window 10 of a vehicle, such as an automobile, is illustrated generally having an AM antenna 12 and a combination FM antenna and defogger grid 20 embedded within the window 10. The AM antenna 12 is shown as a stand-alone antenna for receiving amplitude modulation (AM) radio frequency (RF) signals. The FM antenna and defogger grid 20 is electrically energizable to heat the window 10 to eliminate condensation and ice from the window, and further is utilized as part of the FM antenna for receiving frequency modulation (FM) radio wave signals.

The AM antenna 12 is shown generally made up of three horizontal and generally parallel conductive elements 14, each coupled at one end to a signal bus bar 16. The horizontal conductive elements 14 may be configured in different lengths and numbers. The signal bus bar 16 is coupled to a terminal 18 which, in turn, is coupled to an amplifier module 64 via line 62 to transmit the received AM signals to the amplifier module 64 to amplify the received AM signals for use in a radio.

The FM antenna and defogger grid 20 is shown formed below, the AM antenna 12 and extends across a substantial area of the window 10. The antenna and defogger grid 20 includes an array of horizontal and generally parallel conductive elements 22, each extending between a negative defogger bus bar 24 on the left side and a positive defogger bus bar 26 on the right side. Bus bars 24 and 26 are located near the left and right edges, respectively, of window 10. Negative defogger bus bar 24 contacts a terminal pad 28 which, in turn, is connected to an insulated wire 32 for providing a grounded signal connection to form the negative side of the defogger circuit. Positive defogger bus bar 26 likewise has a terminal pad 30 connected to an insulated wire 34 which receives DC power to form the positive side of the defogger circuit. The terminal pad 30 is further coupled to amplifier module 64 via line 60 to transmit the received FM signals to the amplifier module 64 for use in the radio. During the window defogging operation, bus bar 26 is energized with a positive DC voltage which generates current through each of the horizontal and generally parallel conductive elements 22 to heat window 10 to an elevated temperature for the purpose of eliminating condensation and ice from the window 10.

The FM antenna 20 is also shown including vertical conductive elements 40, 42, 50, and 52, coupled to horizontal tuning elements 44 and 54, according to one example. The example of the antenna and defogger arrangement shown and described herein is further disclosed in U.S. Pat. No. 6,307,516. While a specific AM antenna 12 and FM antenna and defogger grid 20 is shown and described herein, it should be appreciated that the AM antenna, FM antenna, and defogger grid may be configured in various shapes, sizes, and configurations, and may employ various electrical connections.

Figure 2:
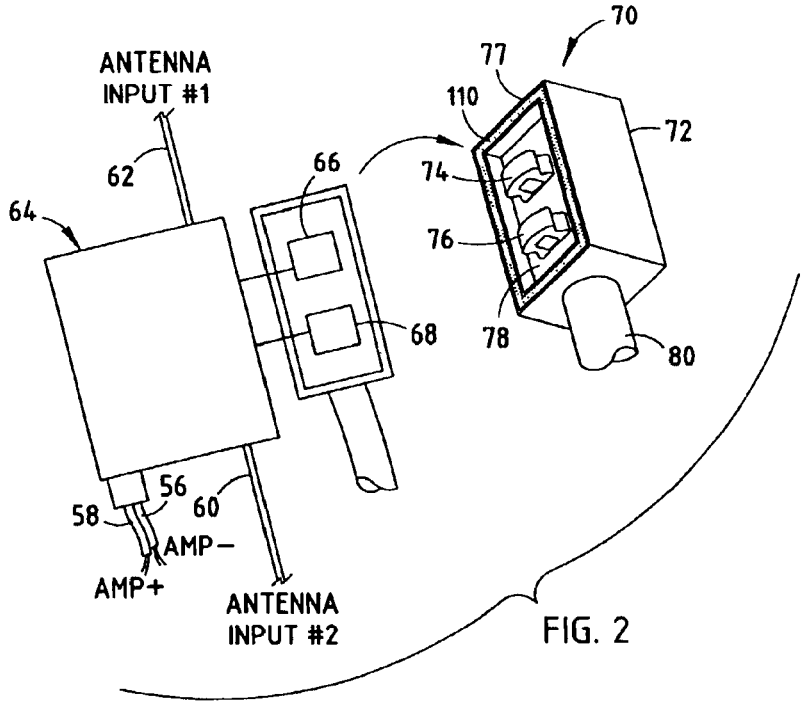
FIG. 2 is an enlarged view of section II showing the electrical connector according to a first embodiment.

The terminal 18 of AM antenna 12 and the terminal 30 of FM antenna 20 are shown connected to an antenna amplifier module 64 via lines 62 and 60 for receiving the AM and FM signals, respectively. Antenna amplifier module 64 has an electronic amplifier for amplifying the AM and FM signals and provides amplified output signals on output contact pad 66. As shown in FIG. 2, amplifier module 64 has power lines 56 and 58 for receiving voltage AMP− and AMP+. Also shown is conductive contact pad 68 for providing a ground connection. Contact pads 66 and 68 are electrically conductive contact pads formed on the windshield 10 and configured to engage conductive contacts on an electrical cable connector 70 for forming an electrical connection with a coaxial cable 80 according to the present invention.

The electrical connector 70 is shown in FIGS. 2 through 5 for forming electrical connections between a pair of circuit elements in the coaxial cable 80 and the output pads 66 and 68 according to one embodiment. The electrical connector 70 includes first and second compressible conductive contacts 74 and 76 electrically coupled to first and second electrical circuit elements in the coaxial cable 80. Conductive compressible contacts 74 and 76 are disposed within a cavity 78 of housing 72 of the electrical connector 70. The electrical connector 70 is particularly shown in detail in FIGS. 3 and 4, according to one example, having a generally rectangular housing 72 with a bottom wall 71 and four upstanding side walls. The housing 72 may be made of a dielectric material. A circular opening 75 is formed in one of the upstanding walls for receiving the coaxial cable 80. The first and second conductive compressible contacts 74 and 76 are disposed within the cavity 78 of housing 72 and form an electrical interconnection with the electrical circuitry in the coaxial cable 80. According to one embodiment, compressible contacts 74 and 76 are made of conductive silicone.

Figure 3:
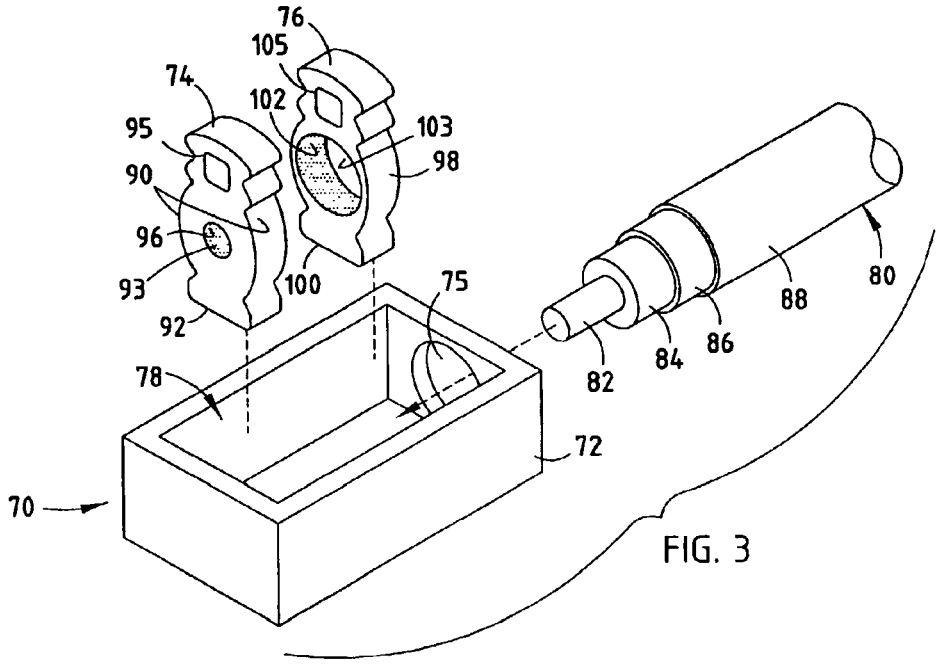
FIG. 3 is an exploded view of the electrical connector shown in FIG. 2.

With particular reference to FIG. 3, the coaxial cable 80 includes a central conductor 82 serving as the first circuit element and surrounded by a dielectric layer 84. Disposed about dielectric layer 84 is an outer conductive shield 86 serving as the second circuit element which is dielectrically isolated from central conductor 82. The conductive shield 86 forms a grounded shield to shield electrical and electromagnetic radiation from adversely affecting signals transmitted on central conductor 82. Also shown disposed over the conductive shield 86 is an outer dielectric layer 88. The coaxial cable 80 is shaped at one end such that the central conductor 82 extends from dielectric layer 84 to engage the first compressible contact 74. The outer conductive shield 86 is exposed to engage the second compressible contact 76.

The first conductive compressible contact 74 includes an opening 93 sized to receive the central conductor 82 of coaxial cable 80 to form an electrical connection therewith. The central conductor 82 is adhered to the inner wall forming opening 93 of contact 74 via a conductive adhesive 96. Central conductor 82 could alternately be electrically coupled to contact 74, such as via a compression fitting. The compressible contact 74 further includes a base 92 for engaging bottom wall 71 of housing 72. The compressible contact 74 has side walls 90 and a hollow cavity 95 that forms a compression zone rear the upper end of the contact 74. The side walls 90 are intended to compress within the compression zone to provide a spring-like bias force such that the contact 74 is compressible to provide a bias force against the first contact pad 66.

The second conductive compressible contact 76 includes an opening 103 sized to receive the outer shield 86 of coaxial cable 80 to form an electrical connection therewith. The outer shield 86 of coaxial cable 80 is adhered to the inner wall forming opening 103 via a conductive adhesive 102. Outer shield 86 could alternately be electrically coupled to contact 76, such as via a compression fitting. The second conductive compressible contact 76 has a base 100 for engaging bottom wall 71 of housing 72. The second conductive compressible contact 76 likewise includes side walls 98 and a hollow cavity 105 that forms a compression zone to allow the contact 76 to compress to provide a spring-like bias force against the second contact pad 68.

Figure 4:
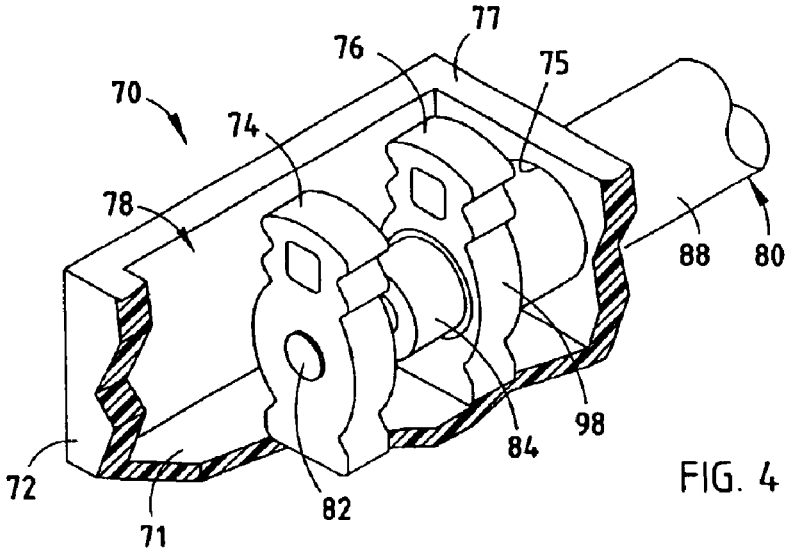
FIG. 4 is a partially cut away view of the electrical connector shown in FIG. 2.
Figure 5:
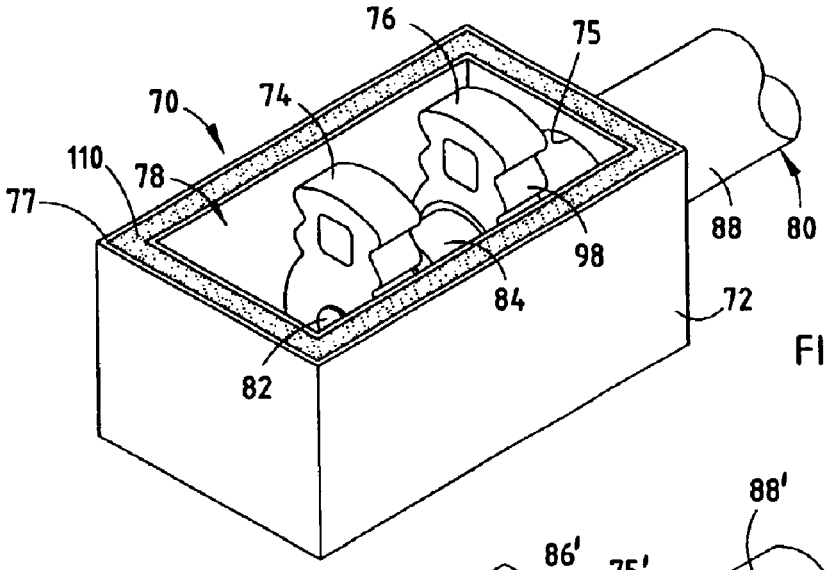
FIG. 5 is a perspective view of the electrical connector shown in FIG. 2.

To assemble the electrical connector 70, the coaxial cable 80 with the end formed as shown in FIG. 3, is inserted into opening 75 such that central conductor 82 extends within opening 93 of first compressible contact 74 and the outer conductive shield 86 extends within opening 103 of second compressible contact 76 as shown in FIGS. 4 and 5. Conductive adhesives 96 and 102 are allowed to cure to adhere the circuit elements 82 and 86 to compressible contacts 74 and 76, respectively. Once the circuit elements 82 and 86 of coaxial cable 80 are coupled to compressible contacts 74 and 76, the electrical connector 70 may be over molded in a mold to provide an over molded electrical connector. It should further be appreciated that the cavity 78 of housing 72 could be partially or substantially filled with a dielectric medium, such as a polymeric material, to strengthen the electrical connection and prevent damage thereto. However, any polymeric fill material should not excessively restrict compression of the compressible contacts 74 and 76 within the respective compression zones. Alternately, the connector 70 could be snapped or hinged together with the cable 80.

The electrical connector 70 has an upper flat peripheral surface 77 on housing 72 for engaging a dielectric medium, such as a glass window (e.g., rear window 10 or windshield on a vehicle). The upper flat peripheral surface 77 of housing 72 is adhered via a non-conductive high temperature adhesive 110 to the window such that the first and second compressible contacts 74 and 76 are compressed against conductive contact pads 66 and 68, respectively, on the window. In doing so, the compressible contacts 74 and 76 at least partially compress within the respective compression zones to provide compressed electrical connections with contact pads 66 and 68. The adhesive 110 holds the compressible contacts 74 and 76 under compression, thus providing electrical connection to the contact pads 66 and 68. This allows installation of the coaxial cable 80 to be independent of the installation of the amplifier module 64 and contact pads 66 and 68.

Figure 6:
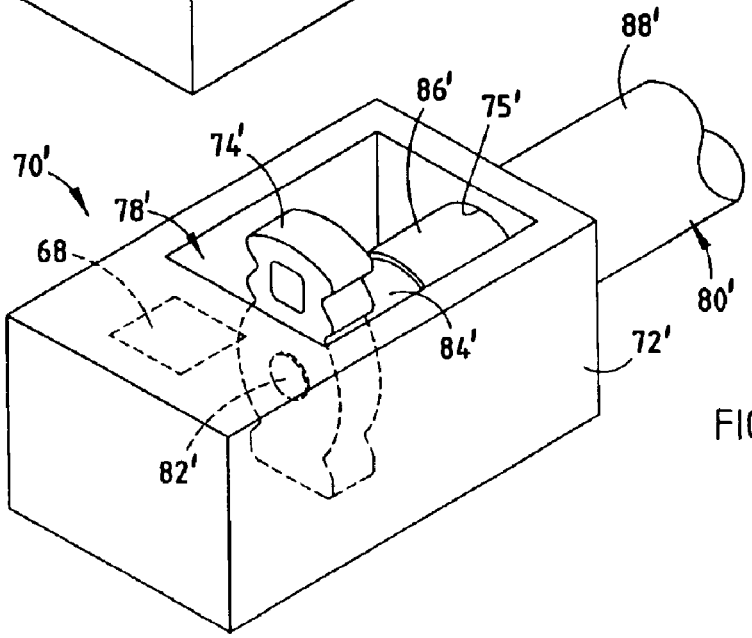
FIG. 6 is a perspective view of an electrical cable connector according to a second embodiment of the present invention.

Referring to FIG. 6, an electrical cable connector 70' is illustrated according to a second embodiment of the present invention. The electrical connector 70' includes a single compressible conductive contact 74' in electrical contact with a central conductor 82' of a coaxial cable 80'. The coaxial cable 80' includes the central conductor 82', a surrounding dielectric layer 84', and an outer conductive shield 86'. The electrical connector 70' includes a conductive housing 72' electrically coupled to the outer conductive shield 86' of coaxial cable 80'. The conductive shield 86' is surrounded by a dielectric layer 88' outside of connector 70'. The electrical connector 70' includes only a single conductive compressible contact 74', in contrast to two compressible contacts as described above. Contact 74' is dielectrically isolated from housing 72'. The second conductive contact pad 68 formed on the dielectric medium (e.g., window) is intended to contact the conductive housing 72' as shown by dashed line 68 (e.g., via conductive adhesive). Accordingly, the conductive housing 72' of electrical connector 70' provides a second conductive circuit path for electrically coupling the contact pad 68 to the outer conductive shield 86' of coaxial cable 80'.

It should further be appreciated that the electrical connector 70 or 70' could alternately be configured to provide a compressible contact disposed against one or more contact pads 66 or 68 provided on the dielectric medium (e.g., glass window). It is further conceivable that a compressible member could be disposed between the window and one or both of conductive contact pads 66 and 68 to provide a compressible electrical connection between contact pads 66 and 68 and contacts on the electrical connector 70 or 70'.

Accordingly, the electrical cable connector 70 or 70' provides an easy to assemble electrical connection for connecting an electrical circuit on a dielectric medium, such as a glass window or an electrical module, and circuit elements in a cable. The electrical connector 70 or 70' can be easily installed by adhering the connector 70 or 70' to the dielectric medium. The electrical connector 70 or 70' eliminates the need for solder connections. It should further be appreciated that while the electrical connector 70 or 70' is shown for connecting AM and FM signal lines to a radio, it should be appreciated that the connector 70 or 70' may be employed for other types of signals and power transmissions. For example, the electrical connectors 70 or 70' could be employed to provide a power supply connection and ground connection to defogger elements on a window for defogging the window. The electrical connector 70 or 70' may further include one or more locating features for aligning and installing the connector 70 or 70' to the dielectric medium. The housing 72 or 72' of connector 70 or 72 may further include a stress relief mechanism.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. An electrical connector for electrically coupling a first circuit element in a cable to a second circuit element on a dielectric medium, said connector comprising:

a housing connected to an electrical cable having a first circuit element, said housing having a cavity and a surface for engaging a dielectric medium; and a first compressible conductive contact disposed within the cavity of the housing and including an opening sized to receive and electrically couple to the first circuit element in the cable, wherein the first compressible conductive contact is compressed to contact a second circuit element formed on the dielectric medium when the surface of the housing is engaged to the dielectric medium to provide an electrical connection.

2. The electrical connector as defined in claim 1, wherein the electrical cable comprises a coaxial cable.

3. The electrical connector as defined in claim 2 further comprising a second compressible conductive contact disposed in the cavity of the housing and including an opening sized to receive and electrically couple to a third circuit element in the coaxial cable, wherein the second compressible conductive contact is compressed to contact a fourth circuit element formed on the dielectric medium when the surface of the housing is engaged to the dielectric medium to form an electrical connection.

4. The electrical connector as defined in claim 1, wherein the dielectric medium comprises glass.

5. The electrical connector as defined in claim 4, wherein the glass comprises a window on a vehicle.

6. The electrical connector as defined in claim 1, wherein the first compressible conductive contact is connected to the first circuit element via a conductive adhesive.

7. The electrical connector as defined in claim 1, wherein the housing is molded to the electrical cable containing the first circuit element.

8. The electrical connector as defined in claim 1, wherein the surface of the housing is engaged to the dielectric medium via an adhesive.

9. The electrical connector as defined in claim 1, wherein the housing is electrically conductive and is electrically coupled to a third circuit element and a fourth circuit element, and the housing is electrically isolated from the first and second circuit elements.

10. An electrical connector for electrically coupling a first circuit element in a cable to a second circuit element on a dielectric medium, said connector comprising:

a housing connected to an electrical cable having a first circuit element, said housing having a cavity and a surface for engaging a dielectric medium;

a first compressible conductive contact disposed within the cavity of the housing and including an opening sized to receive and electrically couple to the first circuit element in a cable, wherein the first compressible conductive contact is compressed to contact a second circuit element formed on the dielectric medium when the surface of the housing is engaged to the dielectric medium to form a first electrical connection; and a second compressible conductive contact disposed within the cavity of the housing and including an opening sized to receive and electrically couple to a third circuit element in the cable, wherein the second compressible conductive contact is compressed to contact a fourth circuit element formed on the dielectric medium when the surface of the housing is engaged to the dielectric medium to form a second electrical connection.

11. The electrical connector as defined in claim 10, wherein the cable comprises a coax cable having an inner conductor forming the first circuit element and an outer conductor dielectrically isolated from the inner conductor and forming the third circuit element.

12. The electrical connector as defined in claim 10, wherein the second and fourth circuit elements are electrically coupled to an antenna formed on a window.

13. The electrical connector as defined in claim 10, wherein the dielectric medium comprises glass.

14. The electrical connector as defined in claim 13, wherein the glass comprises a window on a vehicle.

15. The electrical connector as defined in claim 10, wherein the first compressible conductive contact is connected to the first circuit element via conductive adhesive and the second compressible conductive contact is connected to the third circuit element via conductive adhesive.

16. The electrical connector as defined in claim 10, wherein the housing is molded to the electrical cable containing the first and third electrical circuits.

17. The electrical connector as defined in claim 10, wherein the surface of the housing is engaged to the dielectric medium via an adhesive.

18. An electrical connector for electrically coupling a first circuit element to a second circuit element formed on a vehicle window, said connector comprising:

a housing receiving a first circuit element, said housing having a cavity and a surface for engaging the window; and a first compressible conductive contact disposed within the cavity of the housing and including an opening sized to receive and electrically couple to the first circuit element, wherein the first compressible conductive contact is compressed to contact a second circuit element formed on the window when the surface of the housing is engaged to the window to form an electrical connection.

19. The electrical connector as defined in claim 18 further comprising a second compressible conductive contact disposed in the cavity of the housing and including an opening sized to receive and electrically couple to a third circuit element, wherein the second compressible contact is compressed to contact a fourth circuit element formed on the window when the surface of the housing is engaged to the window to form an electrical connection.

20. The electrical connector as defined in claim 19, wherein the first and third circuit elements are provided in a coaxial cable.

21. The electrical connector as defined in claim 18, wherein the surface of the housing is engaged to the window via an adhesive.

22. The electrical connector as defined in claim 18, wherein the housing is electrically conductive and is electrically coupled to a third circuit element and a fourth circuit element, and the housing is electrically isolated from the first and second circuit elements.

23. The electrical connector as defined in claim 1, wherein the first conductive compressible contact comprises a base, side walls, and a hollow cavity that forms a compression zone, wherein the base engages a wall of the housing and the side walls compress within the compression zone to provide a bias force against the second circuit element on the dielectric medium.

24. The electrical connector as defined in claim 1, wherein the first compressible conductive contact comprises conductive silicon.

25. The electrical connector as defined in claim 3, wherein the second compressible conductive contact comprises a base, side walls, and a hollow cavity that forms a compression zone, wherein the base engages a wall of the housing and the side walls compress within the compression zone to provide a bias force against the second circuit element on the dielectric medium.

26. The electrical connector as defined in claim 3, wherein the second compressible conductive contact comprises conductive silicon.

27. The electrical connector as defined in claim 10, wherein each of the first and second compressible conductive contacts comprises a base, side walls, and a hollow cavity that forms a compression zone, wherein the base engages a wall of the housing and the side walls compress within the compression zone to provide a bias force against the second circuit element on the dielectric medium.

28. The electrical connector as defined in claim 10, wherein each of the first and second compressible conductive contacts comprises conductive silicon.

29. The electrical connector as defined in claim 18, wherein comprises a base, side walls, and a hollow cavity that forms a compression zone, wherein the base engages a wall of the housing and the side walls compress within the compression zone to provide a bias force against the second circuit element on the window.

30. The electrical connector as defined in claim 18, wherein the first compressible conductive contact comprises conductive silicon.

31. The electrical connector as defined in claim 19, wherein the second compressible conductive contact comprises a base, side walls, and a hollow cavity that forms a compression zone, wherein the base engages a wall of the housing and the side walls compress within the compression zone to provide a bias force against the second circuit element on the window.

32. The electrical connector as defined in claim 19, wherein the second compressible conductive contact comprises conductive silicon.

* * * * *